United States Patent [19]

Geyer, Jr. et al.

[11] 4,224,866

[45] Sep. 30, 1980

[54] TREATMENT OF RAYON STAPLE

[75] Inventors: Charles J. Geyer, Jr., Berwyn; Ben E. White, Wayne, both of Pa.

[73] Assignee: Fiber Associates, Incorporated, Berwyn, Pa.

[21] Appl. No.: 75,118

[22] Filed: Sep. 13, 1979

[51] Int. Cl.[3] ..... B30B 13/00; B06B 1/00

[52] U.S. Cl. ..... 100/40; 8/151; 68/13 R; 68/22 R; 100/37; 100/76; 100/121; 100/176; 242/544

[58] Field of Search ..... 100/40, 37, 76, 121, 100/176; 68/22 R, 13 R; 8/151

[56] References Cited

U.S. PATENT DOCUMENTS

| | | | |
|---|---|---|---|
| 2,265,795 | 12/1941 | Bauer et al. | 68/22 R |
| 3,270,532 | 9/1966 | Chalkin | 68/22 R |
| 3,381,607 | 5/1968 | Clark | 100/37 |
| 3,762,188 | 10/1973 | Bernholz et al. | 68/22 R |
| 3,790,096 | 2/1974 | Brouwer | 242/55 |
| 3,927,504 | 12/1975 | Forrister | 428/906 |
| 3,994,147 | 11/1976 | Dalle et al. | 68/22 R |
| 4,004,879 | 1/1977 | Meier-Windhorst | 8/151 |

*Primary Examiner*—A. Lionel Clingman
*Attorney, Agent, or Firm*—Miller & Prestia

[57] ABSTRACT

In an apparatus for treating a blanket of rayon fibers with a treating solution having means for conveying said blanket and at least one means for compressing out excess solution prior to drying, including means along the edges of said blanket for causing the edges of said blanket to turn in and fold over on itself prior to compression during its advancement along the conveyor means.

4 Claims, 5 Drawing Figures

TREATMENT OF RAYON STAPLE

BACKGROUND OF THE INVENTION

This invention relates to dewatering of rayon staple.

In the production of rayon staple, it is customary to cut the tow of continuous filaments into short fibers (or staple) prior to such treatment as washing and bleaching and application of a fiber finish. The fibers after cutting are formed into a blanket and are advanced through the wet treatment on some form of support such as a screen, belt or alternately on advancing rails.

In the production of rayon staple, a tow is usually cut into filaments and formed into a blanket of fibers wherein it undergoes a variety of treatments such as washing, bleaching, the application of various textile oils or finishes, etc. Upon such further treatment of the blanket of fibers, the excess treating solutions are mechanically held in the interstices of the fibers so that it is necessary to compress the excess solution out by the application of suitable pressure prior to drying. However, due to the uneveness of the blanket, it is quite common that a large excess of solution is still mechanically held along the edges of the blanket and in the vicinity of large clumps so that a large amount of excess heat energy is required in order to remove all of the excess water that has been retained by the fiber blanket. Also, if there is an uneven and insufficient removal of water, there results "wet spots" which cause clumps of tanglements of the fibers in the blanket.

At the present time, no provision has been made in the treatment of rayon staple to solve the problems of uneven water removal along the edges of the blanket

SUMMARY OF THE INVENTION

The present invention relates to a novel method and device for processing a blanket of rayon staple which has been treated with water or other treatment solutions prior to drying. It is therefore the general object of the present invention to provide a method and device for causing the outside portions of a blanket of rayon staple to be positioned so as to be compressed free of excess treating solution prior to drying.

More specifically, it is an object of the present invention to more uniformly compress dry a blanket of rayon staple so as to allow for a more efficient and uniform drying.

In accordance with the present invention, there is provided guides along the side of an advancing blanket of rayon staple, that has been previously pretreated with a treating liquid and passed through compression rolls, that cause the wet edges of the blanket to curl and fold in so that they can be effectively compressed by additional pressure rolls. Due to the additional folding step, the average blanket's homogeneity is improved so that the previously present wet spots are subjected to even roll pressure and eliminated prior to entering the drying zone.

According to the present invention, the folding over of the edges of the blanket is accomplished by the use of side guides which are mounted along the sides of the blanket's conveyor and so constructed as to gradually turn in and fold over said edges as it passes along the conveyor.

Further objects and advantages of the invention will become more apparent from the following description and reference to the drawings.

DESCRIPTION OF THE PREFERRED EMBODIMENT

Figure 1:
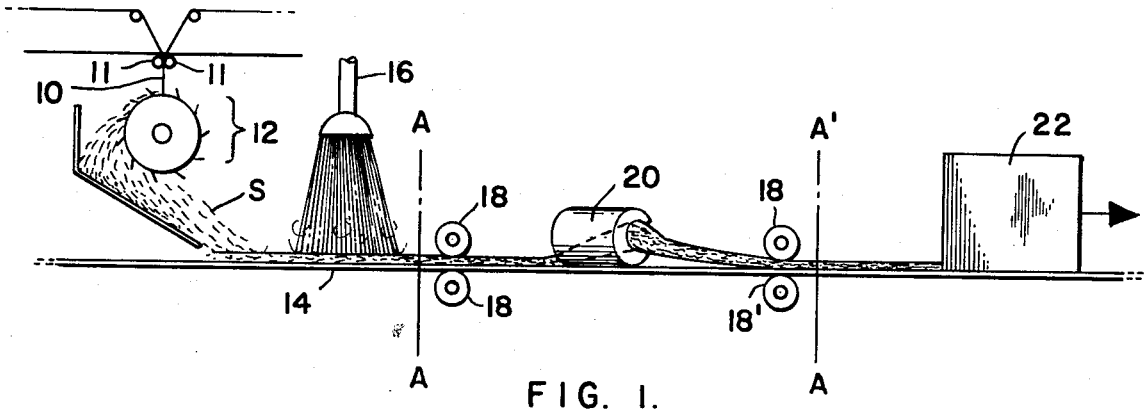
FIG. 1 is a side plan view illustrating the application of the turning device of this invention in an apparatus for processing rayon staple.

Reference is first made to FIG. 1 which shows a process for treating rayon staple which includes the turning device of the present invention. As shown, two or more groups of viscose rayon filaments are combined into a tow after passing over guides 11,11 and are cut into staple S by a cutter schematically indicated in the drawing and designated by the number 12. The cut staple S thus produced is placed onto a conveyor 14 and passed to a processing area 16. At the processing area 16, the blanket of staple is treated by either washing with water, bleaching, or sprayed with treating material. The thus treated fibers then pass through a first pair of compression rolls 18 which remove the excess treating solution. The blanket then passes between one or more pairs of arcuate turning members 20 which fold the edges of the blanket inwardly prior to the application of pressure by compression rolls 18'. The edges of the blanket may be subjected to folding over more than one time in order to obtain better homogeneity prior to entering the drying zone 22.

Figure 2:
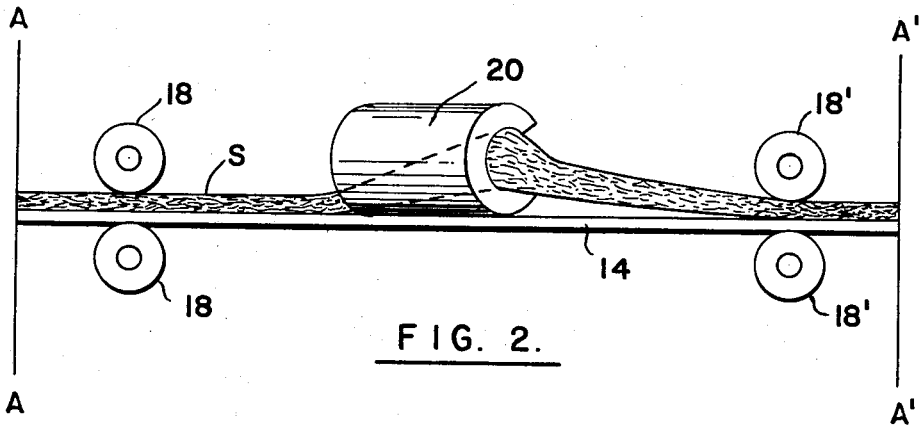
FIG. 2 is a sectional view of the apparatus of FIG. 1 along lines A—A' illustrating in more detail the turning of the edges of the blanket.

As seen in FIG. 2, the blanket as it passes through the turning members 20 has its edges turned and folded inward which decreases its width while increasing its thickness.

Figure 3:
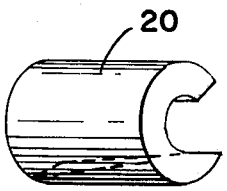
FIG. 3 is a perspective view showing the back portion of the turning device of FIG. 1.
Figure 4:
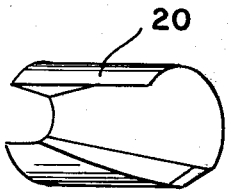
FIG. 4 is a perspective view of the front portion of the turning device of FIG. 1.

As seen in FIGS. 3 and 4, the front portion of the turning member 20 may gradually increase in width so that as the blanket advances therethrough, the width of the blanket gradually decreases and gradually turns the edge of the blanket up along its side and onto itself.

Figure 5:
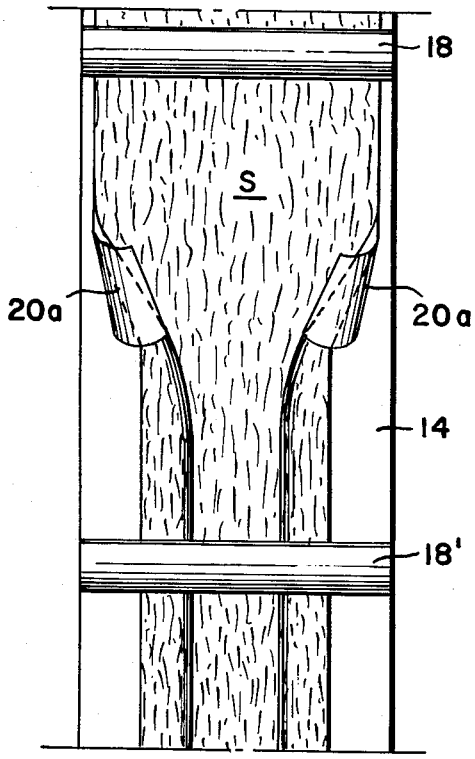
FIG. 5 is a top view of the turning device in accordance with another embodiment of the present invention.

In accordance with the present invention, the turning members 20 may be angularly positioned so as to scoop and turn the blanket on itself as it advances along the conveyor. When the turning members are positioned in such a manner, it is not necessary that the changing width and slope in the turning member be present since the fibers can be scooped and folded by their own momentum. The turning members may merely comprise C-shaped guides, as shown in FIG. 5.

While this invention has been described with respect to specific embodiments, it should be understood that various minor modifications and adaptations of the process and apparatus of the present invention may be made without departing from the true spirit and scope thereof. For example, while this invention has been illustrated in an embodiment involving only a single pair of turning members, it is contemplated that more than one pair of turning members may be utilized and that the blanket undergo more than one folding and/or compression. Accordingly, the appended claims are intended to be construed to cover all such variations and adaptations of the invention which may be made by those skilled in the art without departing from the true spirit and scope thereof.

We claim:

1. In a process for treating a blanket of rayon fibers with liquid wherein said blanket is conveyed along a web and wherein liquid is pressed out of said fibers at least once prior to drying, the steps which comprise turning in and folding the edges of said blanket on themselves during advancement of said blanket along said web, and thereafter subjecting said blanket including its folded portion to compression.

2. In an apparatus for treating a blanket of rayon fibers with liquid including means for conveying said blanket and means for compressing out excess liquid prior to drying, the improvement which comprises folding means arranged along the edges of said blanket for causing the edges of said blanket to turn in and fold over on themselves prior to compression during advancement of said blanket along said conveyor means.

3. The apparatus according to claim 2, wherein said means for turning in the edges comprises at least one pair of arcuate guide members which restrict said blanket so as to cause the edges gradually to turn in and fold over on itself.

4. The apparatus according to claim 3, wherein said guide members are angularly disposed on said conveyor.

* * * * *